United States Patent [19]

Sullivan et al.

[11] 4,207,648

[45] Jun. 17, 1980

[54] MECHANISM FOR ROTATING AND RECIPROCATING A SOOT BLOWER

[75] Inventors: Robert P. Sullivan, Chattanooga; Clyde L. Jacobs, Signal Mountain, both of Tenn.

[73] Assignee: Combustion Engineering, Inc., Windsor, Conn.

[21] Appl. No.: 3,557

[22] Filed: Jan. 15, 1979

[51] Int. Cl.[2] ..... F23J 3/02

[52] U.S. Cl. ..... 15/316 R

[58] Field of Search ..... 15/316 R, 316 A, 317, 15/318; 165/95

[56] References Cited

U.S. PATENT DOCUMENTS

| | | | |
|---|---|---|---|
| 2,257,936 | 10/1941 | Bowers et al. | 15/317 |
| 3,585,673 | 6/1971 | Nelson et al. | 15/317 |

*Primary Examiner*—Christopher K. Moore

*Attorney, Agent, or Firm*—Arthur L. Wade

[57] ABSTRACT

The lance of the soot blower is disclosed as having a square cross section extending through a square hole in a rotating bushing. The square lance is reciprocated into and out of a furnace cavity by means of a carriage positioned through a rack and pinion.

5 Claims, 6 Drawing Figures

MECHANISM FOR ROTATING AND RECIPROCATING A SOOT BLOWER

BACKGROUND OF THE INVENTION

1. Field of the Invention

The present invention relates to the connection between motive means and the lance of a soot blower with which the lance is rotated and reciprocated in carrying out its function of cleaning furnace tubes with a spray of steam, or other cleaning fluid. More specifically, the present invention relates to rotation of a lance of square cross section and reciprocation of the lance as the lance is connected to a carriage within a housing, the reciprocation motivated through a rack on the housing and a pinion on the carriage.

2. Description of the Prior Art

Combustion of fuels in a utility boiler produces huge amounts of particulate matter which accumulates on heated surfaces and reduces the heat transfer from the combustion to liquids to be vaporized. Coal firing is very productive of particulate matter, be it in the form of soot and/or slag. The lower the quality of coal, the more quickly is the accumulation of particulate matter on surfaces heated by the combustion. Removing structure must be frequently inserted into the furnace space to shear away the accumulations which are the enemies of heat transfer.

Enter the lowly soot blower. Essentially, the soot blower is a pipe, with a nozzle at its end, inserted into a hole in the wall of the furnace. Steam, or other vapor, is fed into the tube and ejected from its nozzle with great force. Correctly directed, this vapor-belching tube can effectively shear particulate matter from large areas of the heated surfaces.

In the huge, multi-storied utility boiler, it is not uncommon to supply up to 100 soot blowers. Rows of these blowers are poised at their furnace openings, the rows being on the order of vertical 8' centers. Further, the blowers are rolled into the furnace under elaborate programs to sequentially cut at the accumulations on the heating surfaces and maintain the efficiency of heat transfer from the combustion process to the vaporizable liquid behind the heating surfaces.

The environment in which the soot blower operates is inherently dirty. Coal dust in the atmosphere about a boiler is an unavoidable fact of the life of this tool. This dirt is an enemy to the mechanical system between the electric motive means and the soot blower with which the electric motive means rotates and reciprocates the soot blower lance.

Another point of vulnerability is the packing gland seal by which the cleaning vapor is retained within the lance. Although other vapors could be employed, by and large high pressure steam is the most available cleaning medium. The steam is conducted to each blower through a feed tube and the outer casing of the lance is rotated and reciprocated over a substantial length of the feed tube. Obviously, some form of seal between the outer surface of the feed tube and the inner surface of the outer casing of the lance is necessary to contain the cleaning medium and force it from a nozzle mounted on the forward end of the casing. The seal must be protected from heat and mechanical stress if reasonable life is to be expected. Thus, under the environment about the utility boiler, which is hostile to mechanical motion and sealing, are the problems of dirt isolation to preserve efficient articulation of the parts of the blower which must move relative to each other.

SUMMARY OF THE INVENTION

The present invention contemplates the external cross section of a soot blower lance casing, having straight sides engaged by a hole with matching straight sides in a bushing mounted at the furnace wall and rotated by linkage to a motive means.

The invention further contemplates a housing for the lance and the carriage to which it is connected which extends backward from the furnace wall in support of the carriage and in formation of a linkage between the motive means and the carriage to provide reciprocation.

The invention further contemplates a carriage, and track for the carriage, connected at the rear end of the lance which fully supports the back end of the lance and the feed tube to obviate mechanical stress on the seal between the lance and the feed tube.

Other objects, advantages and features of this invention will become apparent to one skilled in the art upon consideration of the written specification, appended claims and attached drawings.

BRIEF FIGURE DESIGNATIONS

DESCRIPTION OF THE PREFERRED EMBODIMENT

Figure 1:
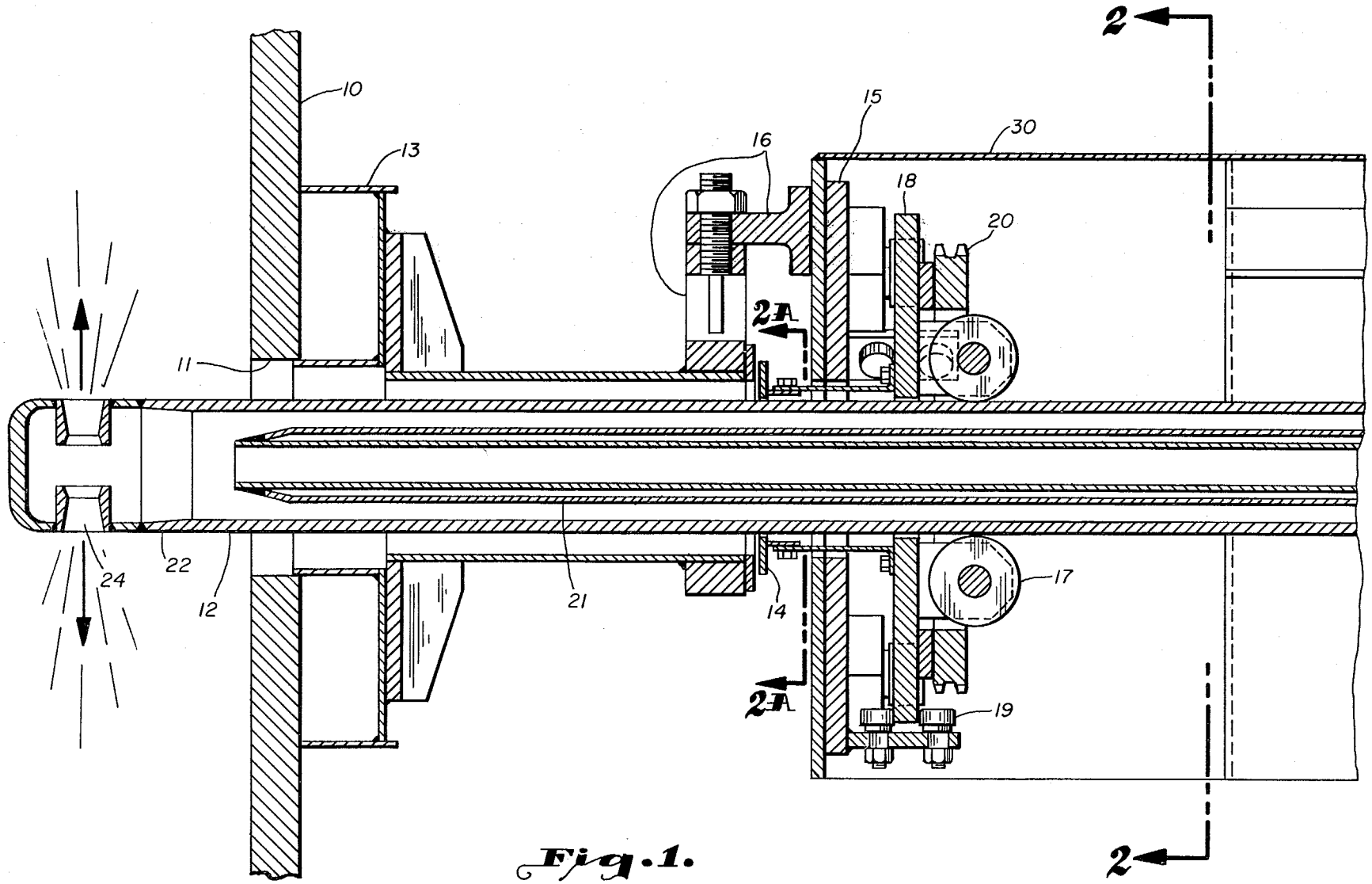
FIG. 1 is a sectioned elevation of the front end of a lance penetrating a furnace wall as rotated through a powered bushing and embodying the present invention.

Plan of the Disclosure:

Featured attraction of the disclosure is the lengthy body of the lance which is thrust into the furnace space for twenty feet, or more, to carry out its cleaning mission. Unique structure is arranged at various stations along this length. An overall grasp of this structure, at these stations, is difficult to extract from a single sheet of drawing. Therefore, the plan descends to a more or less piecemeal consideration of the structure embodying the invention along the length of the lance. Those skilled in the art will have to meet the test of organizing the disclosure from the various figures scattered over multiple sheets of drawing.

In orientation, the end of the lance of the soot blower viewed in FIG. 1 will be described as the "front" end. It is the cleaning fluid which is discharged from the nozzles on the front end of the lance which carries out the cleaning of the surfaces in the furnace interior. Looking backward from this nozzle end of the lance, supporting structure at the furnace wall is first analyzed in the first two figures of the drawing. Attention next shifts to the carriage structure to which the rear portion of the lance is attached. This carriage structure is reciprocated toward and away from the furnace interior to carry the lance nozzles over and/or between the furnace surfaces being cleaned. The disclosure next includes drawings depicting the structure with which the feed tube is held in alignment to avoid mechanical stress on the all-important packing gland seal between the feed tube surface and the casing of the lance. Seen in the overall organization of supporting and articulating structure for the lance are features which give the soot blower distinct advantages over the prior art. In the final analysis the structure is simple and inherently resists the accumulation of dirt which always threatens to degenerate the performance efficiency of soot blowers of the prior art.

Figure 2:
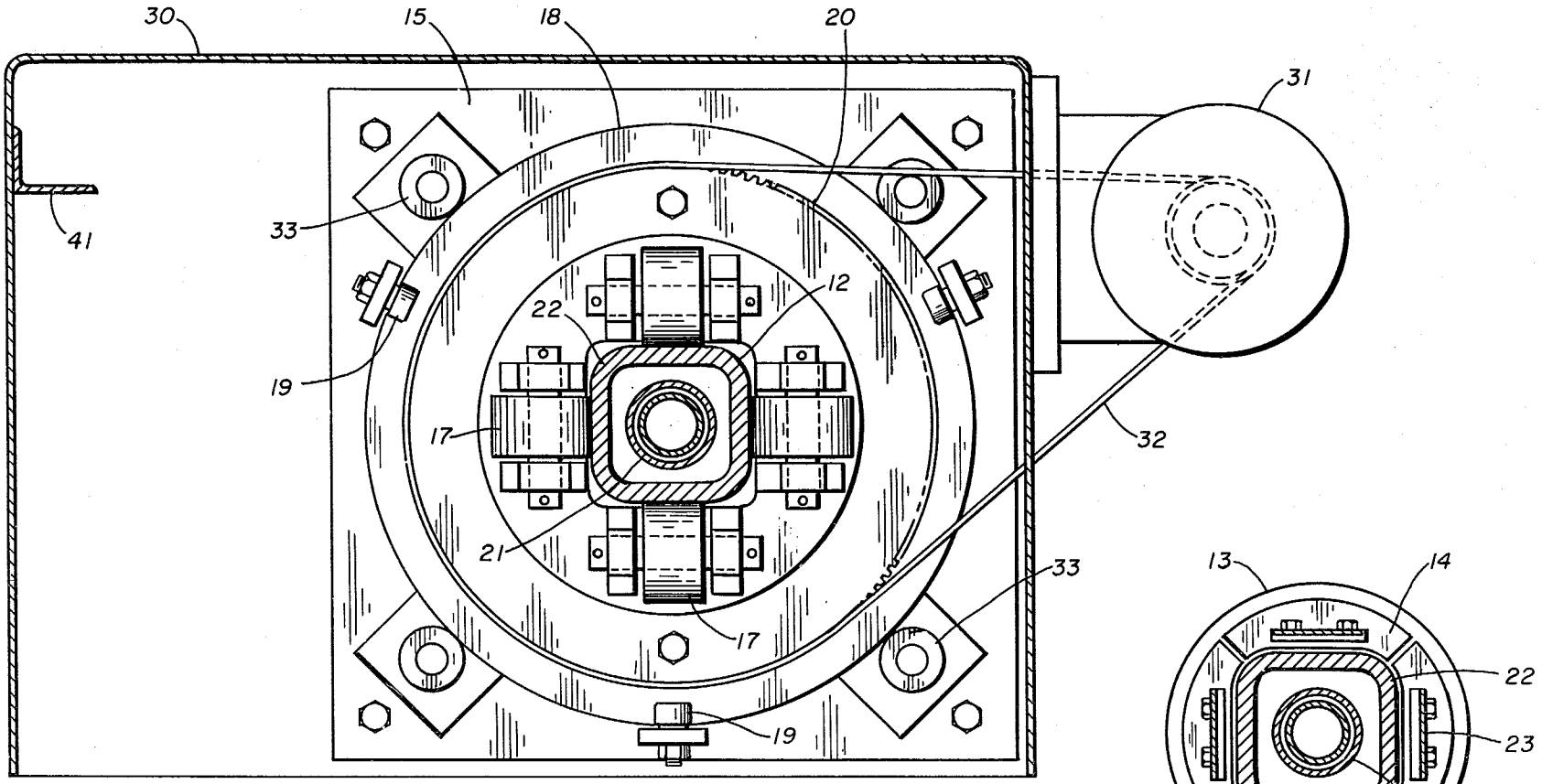
FIG. 2 is a sectioned elevation along lines 2—2 of FIG. 1 of the bushing structure with which the lance is rotated.
Figure 2A:
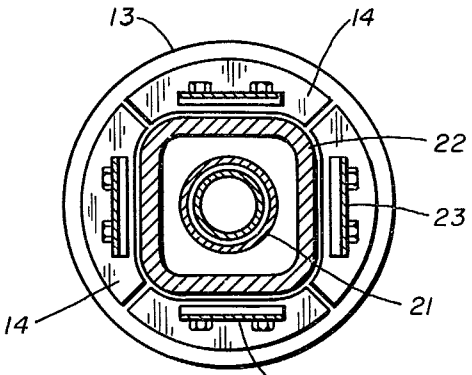
FIG. 2A is a sectioned elevation along lines 2A—2A of FIG. 1 of the scraper plate as about the lance casing and suspended from the guide ring of the bushing structure.

FIGS. 1, 2 and 2A—Front End:

The structure of FIG. 1 includes a portion of the furnace wall with an opening through which the cleaning lance is reciprocated and rotated to project its cleaning fluid over the surfaces of the furnace interior to rig them of soot and slag. FIG. 1 discloses the structure mounted at the furnace wall aperture which maintains the lance in alignment with the aperture in the furnace wall and rotates the lance as the lance is reciprocated by structure shown in subsequent figures.

The furnace wall, or that portion of the wall which is penetrated by the lance, is designated 10. The aperture 11 is shown with the lance 12 thrust partway into the furnace interior. The configuration of the external casing of the lance 12 is essentially square and rotates in the position shown in FIG. 1. Therefore, aperture 11 is sized to accommodate this rotation without interference.

Of course, there are hot gases streaming up through the furnace interior. In the present disclosure, the assumption is made that the furnace operates at a negative pressure. More specifically, the flow of air through aperture 11 will be toward the furnace interior. However, the radiant heat within the furnace is to be blocked by a structure mounted on the outside of furnace wall 10. The structure on the external side of wall 10 is a seal box 13.

The seal box 13 extends back to scraper plate 14, which plate encompasses the rotating and reciprocating outer surface of lance 12.

The seal box structure is a sturdy mount forming a link between the furnace wall and the front end of the lance 12. More specifically, the seal box 13 is connected to a shroud enclosure for the reciprocating carriage of the lance. This connection is illustrated with yoke and bracket 16. Within the shroud housing is mounted, at the front end of the shroud, bearing assembly 15 which is the link between the lance and a motive means disclosed in FIG. 2 with which the lance is rotated.

Roll bearings 17 are mounted on a guide ring 18 which is captured between eccentric side camrol bearings 19 fixed to bearing assembly 15. Guide ring 18 is rotated in the plurality of bearings 19 and 33 by means of a chain shown in FIG. 2 which engages sprocket 20. It is apparent from the drawings of FIGS. 1 and 2 that the rotation of guide ring 18 results in rotation of roll bearings 17 which completes the direct link with the external surface of the square casing of the lance.

Although not completely apparent from FIG. 1, the external configuration of lance 12 provides a cross-sectional profile with four flat sides. Roughly, the external shape of the lance can be referred to as square, at least two of the sides of the square at any one time engaged in rolling contact with roll bearings 17. In the final analysis, the assembly thus far described is a compact structure which both admits of access to the furnace interior by the lance 12 through aperture 11 while blocking radiant heat about the lance structure and forming a mechanical link with a motive means for rotation of a lance while the lance is reciprocated.

FIG. 2A discloses details of the scraper plate 14, in its position to block the escape of radiant heat of the furnace through aperture 11. Scraper plate 14 is suspended from guide ring 18 and, therefore, rotates with guide ring 18 and lance 12.

FIG. 2A discloses scraper plate 14 as comprised of four scraper plate segments—14A, 14B, 14C, and 14D. An edge of each of the four segments is positioned closely adjacent one side of the lance casing. The four segments fit together in a plane normal the axis of the lance. The four segments, together as the scraper plate 14, are spaced closely adjacent the rear end of the seal box 13. Positioned in this arrangement about the lance casing, the segments block the escape of radiation from the furnace interior and remove soot and/or slag from the external lance casing 22 as the lance 12 is retracted from the furnace interior.

Each segment is held in its position by a strap, which connects the segment to the guide ring 18. Therefore, strap 23A connects segment 14A to the guide ring 18. Likewise, the remaining three straps connect their respective segments to the guide ring. The now obvious result for this assembly is the rotation of scraper plate 14 with guide ring 18 and external lance casing 22.

It may appear that the segments 14A–14D are somewhat precariously held in their positions from guide ring 18. It is true that straps 23A–23D are relatively elongated members. However, in their actual reduction to practice, they are normally sturdy enough to maintain their segment of the scraper plate in position while retaining flexibility to prevent binding and galling on the reciprocating surface of the external lance casing 22.

The description here is of a soot blower classed as a "long, reciprocating" type. One common denominator of these soot blowers is a feed tube 21 which provides the cleaning fluid ultimately discharged from the lance against internal furnace surfaces. Feed tube 21 must be long enough to maintain communication of its cleaning fluid with the nozzles 24 at the forward end of the casing of the lance while the lance is reciprocated over its range of longitudinal movement. The external lance casing 22 must be effectively sealed near its rear end against the escape of cleaning fluid which has been conducted into the casing. This seal structure is not disclosed in the front end apparatus of FIG. 1, the lance and feed tube extending a substantial distance beyond the boundary of FIG. 1, as will be shown in subsequent figures.

Assuming a seal between the internal wall of the lance casing and the external surface of the feed tube is provided in subsequent disclosures, it can well be appreciated that a horrendous problem with this seal hangs over the lance. The prior art may speak profusely of many different fluids which can be provided for the soot blowers, but high pressure, high temperature steam available as a product from the furnace itself is the most practical cleaning fluid available. This steam in feed tube 21 is surpassingly warm. The life of a seal reciprocating and rotating along the external surface of the feed tube 21 will be threatened by the elevated temperature of the steam within the feed tube. One barrier to this heat flow is an insulating structure about the feed tube.

None of the structure so far disclosed touches the reciprocating mechanism to which the lance 12 is connected. The disclosure of FIG. 1 is basically designed to teach the mechanism mounted near the furnace wall through which the lance is rotated and in which reciprocation is accommodated.

FIG. 2 coordinates with FIG. 1 by the fact that FIG. 2 is a section along line 2—2 in FIG. 1. Therefore, the structure of FIG. 2 is viewed as looking into the forward end of the lance or that end extended into the furnace. The bearing assembly 15 is shown as about lance 12 and attached to the front of housing shroud 30. Now the motor 31 is observed in its position to one side of the bearing assembly, rotating the lance through its linkage, including chain 32. The lance is reciprocated within housing shroud 30, retreating and advancing relative to the observer of FIG. 2. The structure for holding the lance in this position and reciprocating the lance will be disclosed in other drawings.

In FIG. 2 the bearing structure holding the guide ring 18 in its position about the lance while it is rotated by motor 31 is more clearly seen. The eccentric side camrol bearings 19 were first disclosed in FIG. 1. The bearings can now all be seen as three sets which are mounted equidistantly around the edge of guide ring 18. Edge bearings 33 engage the edge of guide ring 18, cooperating with bearings 19 to give the guide ring stability while it is rotated by the motor 31. Of course, the guide ring is mounted in the bearing assembly 15 which is mounted on the inside of housing shroud 30. Further, as disclosed in connection with FIG. 1, the housing is suspended from seal box 13 through yoke and bracket 16. Finally, roll bearings 17 are mounted on guide ring 18 to directly engage the surface of external lance casing 22. Thus, the linkage is completed between motor 31 and lance 12 to rotate the lance in distributing its cleaning fluid from the nozzles 24, such nozzles viewable in FIG. 1 but obscured in FIG. 2.

Other views clarify the manner in which the carriage for the lance is reciprocated along a track within housing shroud 30. An indication of this track within the shroud is found at 41.

The purpose of FIG. 2 is simply to enlarge upon, and make more specific, the linkage between motor 31 and the lance 12, the train of linkage including chain 32, the sprocket 20, guide ring 18, and roll bearings 17. Some additional orientation is given by showing the shroud 30 about the lance 12.

Figure 3:
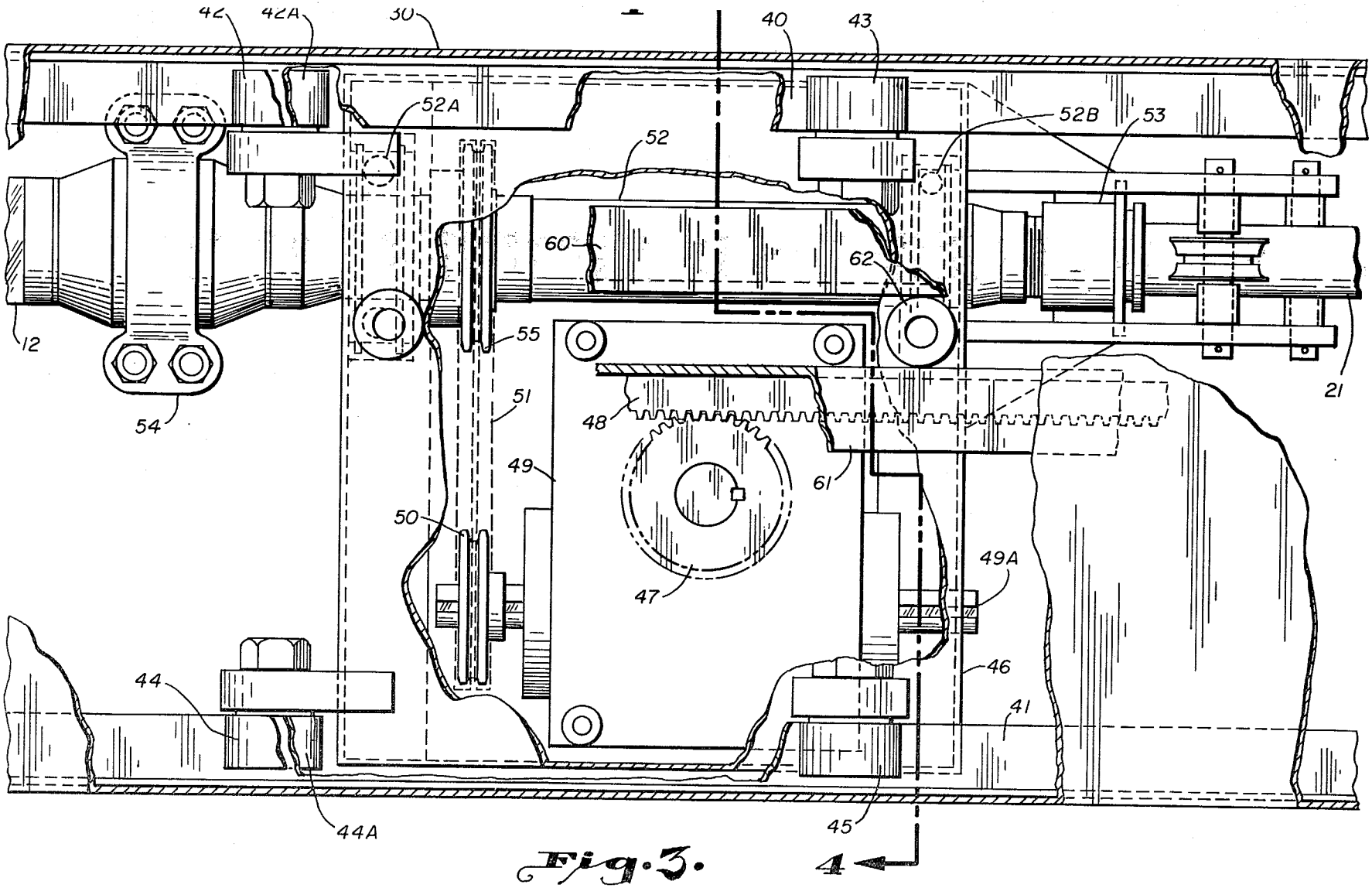
FIG. 3 is a partially sectioned plan view of the carriage to which the rear portion of the lance is connected for reciprocation and rotation.

FIG. 3—The Carrier:

FIG. 3 is a plan view of the carrier mechanism with which the lance is reciprocated into, and out of, the furnace. The carrier mechanism traverses the length of shroud 30. Only the fragments of shroud 30 necessary to orient the carrier within are disclosed.

Basically, the carrier can be studied as a framework supported on parallel tracks within shroud 30. The tracks 40 and 41 are mounted along the sides of shroud 30. Rollers 42 and 43 engage track 40 and rollers 44 and 45 engage track 41. Between these rollers 42–45, the carriage framework 46 is suspended while reciprocated the length of shroud 30 with power transmitted through pinion 47 and rack 48. Roller 42A (under roller 42 and track 40) and roller 44A (under roller 44 and track 41) are used for carrier loading while the lance 12 is extended fully into the furnace space.

Note that pinion 47 extends upward to engage rack 48. Teeth of the rack and pinion are deliberately oriented vertically to militate against the accumulation of dirt within the teeth. The design of prior art soot blowers has consistently included horizontal orientation of rack and pinion teeth. Consequently, prior art teeth have accumulated dirt and debris which has deteriorated the performance of the rack and pinion drives. The present arrangement of soot blower construction makes it evident that vertical tooth orientation was a positive step in lengthening the maintenance-free operation of carriage framework 46.

Gear reducer 49 is mounted below pinion 47 and controls both the speed and direction of pinion 47 rotation to reciprocate the lance attached to the carriage framework 46. Additionally, the gear reducer is connected to sprocket 50 which is linked by chain 51 to provide rotation from the lance.

The lance of FIGS. 1 and 2 is connected to the framework of carriage 46 by a sleeved spindle 52. The spindle is fixed to carriage framework 46 so as to extend toward the furnace at the front end. Further, the sleeve receives feed tube 21 as feed tube 21 is connected to a source of cleaning fluid not shown in FIG. 3. Also, by means of the dead air space between the inner and outer shells of the sleeved spindle 52, high temperatures from steam are greatly reduced to enhance the life of the bearings 52A and 52B that allow rotation of sleeved spindle 52.

Sleeved spindle 52 specifically carries an axially aligned packing housing 53 on what will be termed its rear end. Feed tube 21 is received through this packing housing 53 and is sealed thereto by the all-important packing structure which prevents the rearward escape of the highly pressured cleaning fluid. Thus, the sleeved spindle and its packing housing form the sliding and rotating link between the lance 12 and the feed tube 21. On the forward end of the sleeved spindle 52, the lance 12 is connected through a high quality connector 54. Therefore, travel of the carriage framework 46 the length of shroud 30 carries the lance into and out of operation within its furnace while receiving high pressure cleaning fluid from feed tube 21.

Note that sleeved spindle 52 bears sprocket 55. Obviously, rotation of lance 12 and sleeved spindle 52 will cause rotation of sprocket 55. Next, note that sprocket 50 is mounted on gear reducer 49. Chain 51 links the two sprockets. Therefore, rotation of lance 12 operates gear reducer 49 which, in turn, rotates pinion 47. It follows that carriage framework 46 is reciprocated through engagement of the rack and pinion within housing shroud 30. In conclusion, rotation of lance 12 by motor 31 of FIG. 2 brings about reciprocation of the lance into and out of the furnace being serviced.

The gear train between the rack and pinion and sleeved spindle 52 can be actuated by another source of power. Shaft 49A is provided into gear reducer 49. Rotational power applied to shaft 49A will both reciprocate and rotate lance 12. This means of rotation and reciprocation is alternate to the normal arrangement applying power from motor 31.

The directional controls for gear reducer 49 and the selective clutching between gear reducer 49, pinion 47 and sprocket 50 are not shown in FIG. 3. The details of disclosing how circuits are arranged to control gear reducer 49 would unnecessarily encumber the present disclosure. The novelty of this embodiment centers about the provision of a carriage framework 46 within shroud 30 and the control of the lance through spindle 52 mounted on the carriage. Additionally, the provision of the carriage-mounted spindle provides a unique sealing support at packing housing 53 so that mechanical stress may be isolated with relative ease from the sealing structure.

Figure 4:
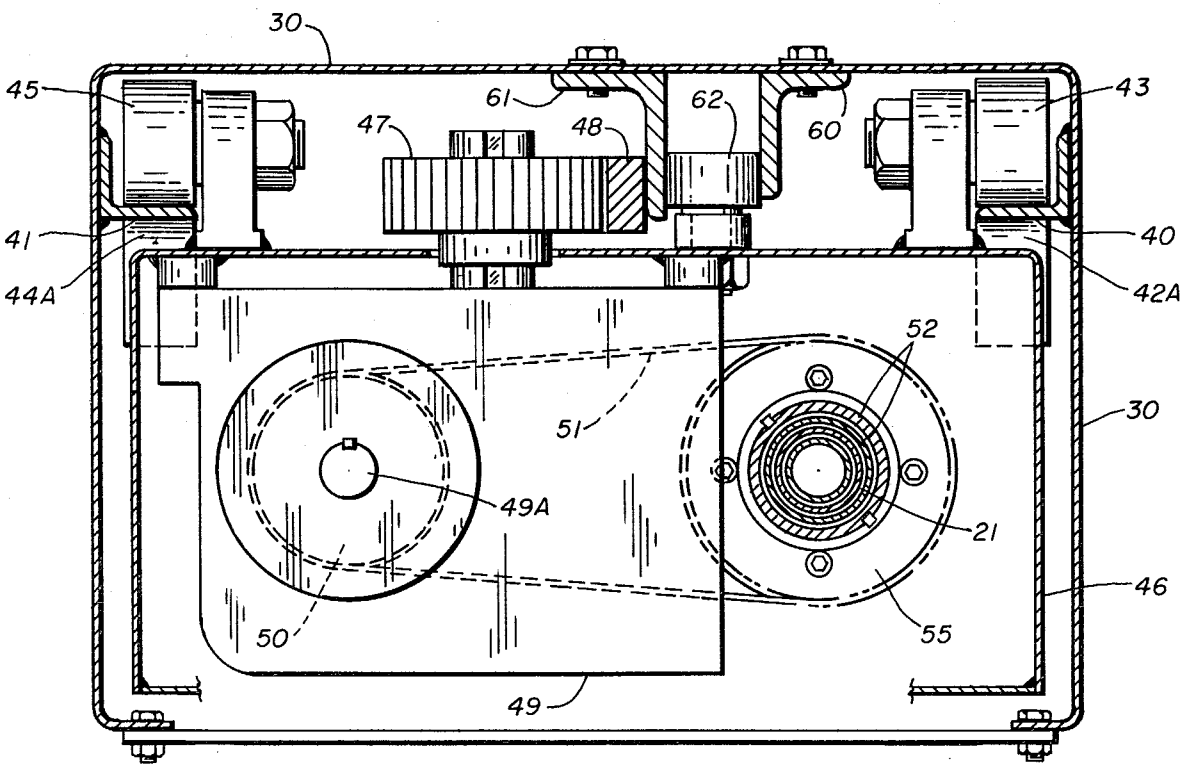
FIG. 4 is a partially sectioned elevation taken along lines 4—4 of FIG. 3 to disclose the carriage on its track reciprocated through a rack and pinion.

FIG. 4—Elevation of FIG. 3 Carrier:

As an elevation of FIG. 3, the view is taken along line 4—4 of FIG. 3. This particular view discloses with great simplicity how carriage framework 46 fits within shroud 30. Tracks 40 and 41 can be seen as essentially angle irons extended horizontally near the top of shroud 30. Rollers 43 and 45 are clearly viewed. Rollers 42 and 44 are not viewable because they are obscured by rollers 43 and 45. Still, it is easily divined how all four rollers bear firmly against their respective tracks in support of carriage framework 46.

Carriage framework 46 reciprocates the longitudinal length of shroud 30. In FIG. 4, this reciprocation causes the carriage framework 46 to recede from and advance toward the eye of the viewer of FIG. 4. Positive guidance in this reciprocating stroke is insured by a sturdy track between the depending flanges of angles 60 and 61. Nestled between these guides is roller 62 which extends from firm attachment to carriage framework 46.

Relative to FIG. 3, the power to reciprocate the carriage framework 46, and its attached lance, has been explained as with gear reducer 49 through pinion 47 and rack 48. The rotation of the gear reducer 49 through sprockets 50 and 55 is clearly disclosed with chain 51. FIG. 4 functions to consolidate the comprehension of how the moving parts of the structure cooperate to positively reciprocate and rotate lance 12.

Figure 5:
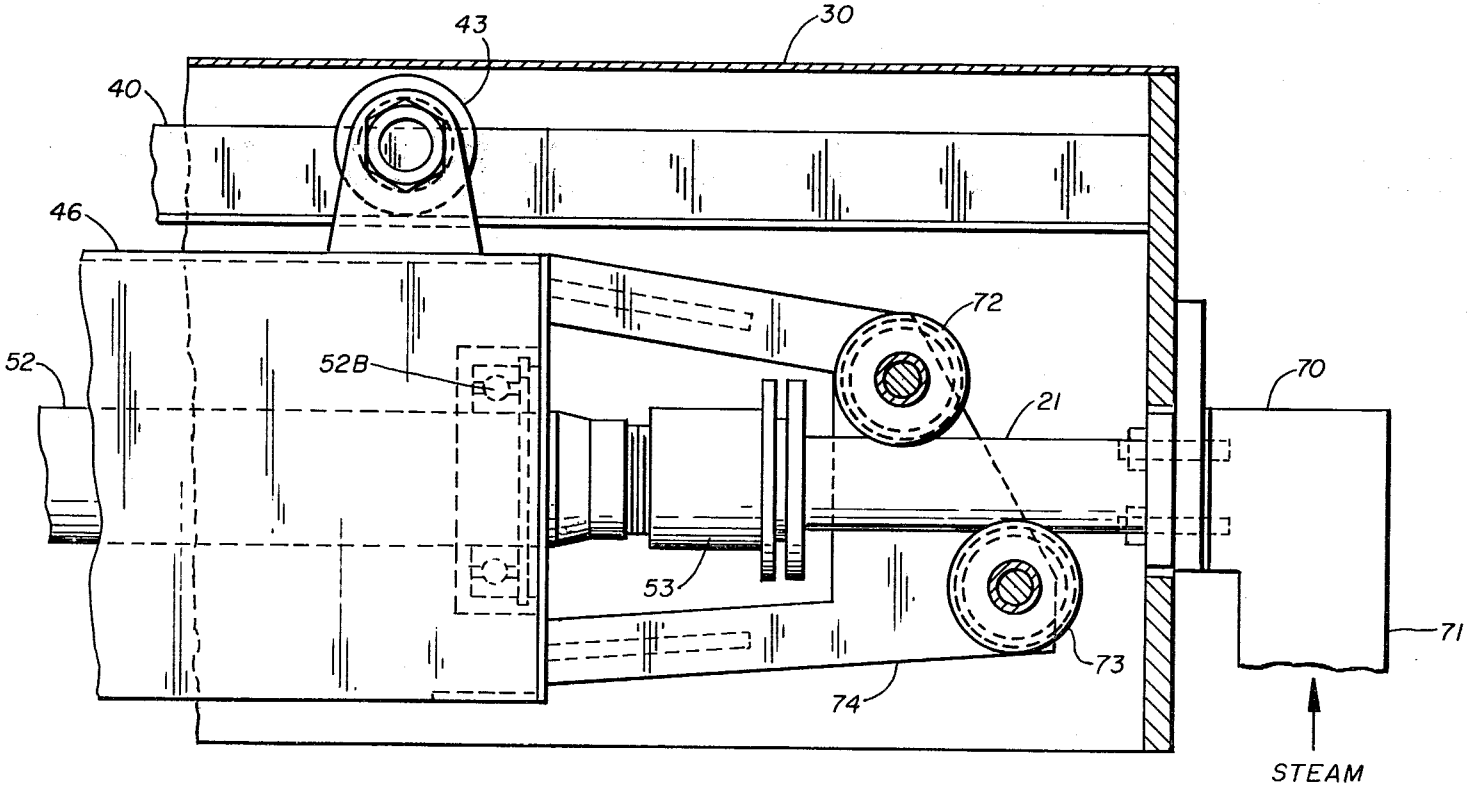
FIG. 5 is a partially sectioned elevation of the rear of the carriage disclosing the structure for aligning and supporting the feed tube.

FIG. 5—Feed Tube Support and Seal:

FIG. 5 may be classified as a somewhat diagrammatic elevation in the rear end of shroud 30 with the carriage framework 46 near the end of tis rear position. The familiar sleeved spindle 52 helps basic orientation in disclosing how feed tube 21 is introduced into connection with the lance through packing housing 53. Valve 70 is indicated as giving basic control to the flow of the cleaning fluid from conduit 71 into feed tube 21. The basic function desired is to flow the cleaning fluid (commonly steam) into the lance from the feed tube 21 in order that the cleaning fluid may be nozzled against the proper interior surfaces of the furnace. The simple end function is complicated by the necessity for reciprocating the lance structure into and out of the furnace while sealed to the external surface of the feed tube. Additionally, rotation of the lance is also desired, putting the seal to further challenge.

This disclosure will not include details of the type, form, and material within packing housing 53, which actually contacts the outside surface of feed tube 21. Isolation of intolerable degrees of heat from the sealed structure has been discussed and there are several established arrangements for attaining this isolation. Simultaneous relief of mechanical stress from the seal is a more pertinent provision in this disclosure of FIG. 5.

Rollers 72 and 73 are mounted on extension 74 of carriage framework 46 to bear directly upon feed tube 21 at its entry into packing housing 53 and its contact with the seal structure within the housing. It is apparent that the parallel axes of the rollers are vertically offset from each other as the rollers bear upon the feed tube 21. These rollers may be positioned and adjusted, in their position, to maintain axial alignment between the feed tube 21 and packing housing 53 to isolate the packing from undue mechanical stress.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

The invention having been described, what is claimed is:

1. A soot blower adapted to be inserted into a furnace to clean steam generating tubes mounted on the walls of the furnace, including, an elongated shroud open on its lower side extending from a position adjacent the external wall of the furnace to a source of cleaning fluid, a track formed on the lower edges of the shroud and extending substantially the length of the shroud, a carriage having rolls engaging the track to support the carriage as the carriage reciprocates the length of the shroud, a sleeved spindle in the form of a tube rotatably mounted on the carriage, a lance structure connected by its back end to the sleeved spindle and extending its front end into a furnace opening, a feed tube connected by the first of its ends to the source of cleaning fluid and extending its second end into the back of the sleeved spindle, a packing gland seal between the outside surface of the feed tube and the interior surface of the sleeved spindle to prevent the escape of the steam from between the outside surface of the feed tube and the interior surface of the sleeved spindle, a rack mounted on the under surface of the top of the shroud and extended substantially the length of the shroud structure, a pinion gear rotatably mounted on the carriage and extending upwardly to engage its teeth with the rack, a motive means connected by a linkage to the lance structure to rotate the lance structure, and a rotative motion transmitting means coupled between the lance structure and the pinion gear to reciprocate the carriage and lance structure through the engagement of the pinion gear with the rack simultaneously with the rotation of the lance structure.

2. The soot blower of claim 1 including, a first wheel mounted on the carriage structure to bear against the upper side of the feed tube, and a second wheel mounted on the carriage structure to bear against the under side of the feed tube with the horizontal axes of the two wheels vertically and horizontally offset, whereby vertical force is directionally exerted against the feed tube to maintain the feed tube and the bore of the sleeved spindle in axial alignment.

3. Structure for actuating a fluid lance into a furnace space for cutting accumulation of particulate matter from heated surfaces within the furnace space, including, a casing for the lance with a cross-sectional configuration of four sides forming a square, a furnace wall with an aperture through which the front end of the lance casing is inserted to position a discharge nozzle to impinge cleaning fluid from within the lance casing on the furnace surfaces to be cleaned, a sealing box mounted on the external side of the furnace wall and about the opening for the lance, an elongated open-bottomed housing connected by its front end to the sealing box in order that the housing will be longitudinally moved as the furnace wall shifts position under the varying thermal loads on the furnace, a guide ring rotatably mounted on the front end of the housing with a central opening accommodating the lance housing, at least two roll bearings mounted on the guide ring to engage flat surfaces of the lance casing, motive means connected to the guide ring for rotation of the guide ring and roll bearings and lance casing, a carriage, mounted to reciprocate on a track mounted in the housing attached to the rear of the lance casing, a rack mounted on the under surface of the top of the housing and extending substantially the length of the housing, a pinion gear rotatably mounted on the carriage and extending upwardly to engage its teeth with the rack, and a rotative motion transmitting means connected between the lance casing and the pinion gear on the carriage, whereby rotation of the lance casing by the motive means simultaneously reciprocates the lance casing into and out of the furnace space.

4. The actuating structure of claim 3, including, a segmented seal plate arranged about the lance casing and closely adjacent the rear end of the seal box to block radiation from the furnace, and a connection between the segmented seal plate and the guide ring by which the seal plate is rotated with the lance casing while radiation is blocked from escape through the seal box.

5. The actuating structure of claim 4, wherein, the seal plate comprises four segments and each segment is connected by a separate elongated support to the guide ring.

* * * * *